US005474113A

United States Patent [19]

Rademacher et al.

[11] Patent Number: 5,474,113

[45] Date of Patent: Dec. 12, 1995

[54] CAN FILLING MACHINE HAVING A MECHANISM TO PREVENT OVERFILL

[75] Inventors: Friedrich Rademacher, Kamen-Südkamen, Germany; Scott D. Mau, Muskego, Wis.

[73] Assignee: H & K Machine, Inc., Waukesha, Wis.

[21] Appl. No.: 283,612

[22] Filed: Aug. 1, 1994

[51] Int. Cl.[6] ..... B67C 3/22

[52] U.S. Cl. ..... 141/31; 141/39; 141/46; 141/116; 141/286; 141/311 A

[58] Field of Search ..... 141/286, 6, 31, 141/39, 40, 46, 115, 116, 311 A; 222/108

[56] References Cited

U.S. PATENT DOCUMENTS

| | | | |
|---|---|---|---|
| 2,063,326 | 12/1936 | Meyer | 141/39 |
| 2,174,384 | 9/1939 | Fouser . | |
| 2,597,943 | 5/1952 | Meyer | 141/39 |
| 3,143,151 | 8/1964 | Denis | 141/302 |
| 3,415,294 | 12/1968 | Kelly | 141/286 X |
| 3,500,879 | 3/1970 | Meyer | 141/286 X |
| 4,086,943 | 5/1978 | Fernandez | 141/39 |
| 4,089,353 | 5/1978 | Antonelli | 141/302 |
| 4,109,446 | 8/1978 | Krohn et al. | 53/282 |
| 4,156,444 | 5/1979 | Mette | 141/286 |
| 4,349,055 | 9/1982 | DiChiara | 141/39 |
| 4,589,453 | 5/1986 | Weiss | 141/39 |
| 4,688,608 | 8/1987 | Puskarz et al. | 141/39 |
| 4,750,533 | 6/1988 | Yun | 141/46 |
| 4,798,234 | 1/1989 | Dugan | 141/165 |
| 4,938,261 | 7/1990 | Petri et al. | 141/39 |
| 4,979,546 | 12/1990 | La Warre, Sr. et al. | 141/286 |
| 5,094,278 | 3/1992 | Arao et al. | 141/311 A |

FOREIGN PATENT DOCUMENTS 1129851 5/1962 Germany .

*Primary Examiner*—J. Casimer Jacyna
*Attorney, Agent, or Firm*—Andrus, Sceales, Starke & Sawall

[57] ABSTRACT

A can filling machine having an improved mechanism to prevent overfill of the can. The machine includes a group of filling heads mounted on a rotatable turntable, and each head includes an outer tubular housing having an open upper end that communicates with a reservoir of the liquid, such as a beverage, which is intended to introduced into the can. A can is moved upwardly and is sealed against a cylindrical tulip that is mounted outwardly of the housing. A fill tube is mounted concentrically within the housing and the space between the fill tube and the housing defines an annular flow chamber for the liquid. Located concentrically within the fill tube is an air vent tube and the lower end of the air vent tube communicates with the can. The lower end of the fill tube carries a valve which is adapted to engage a valve seat on the lower end of the housing. Located in the lower end of the annular flow chamber is a stack of horizontal discs which are spaced vertically apart. The discs have openings so that the liquid flows through the openings and radially through the spaces between discs to the valve. The spacing between the discs is sized to be large enough to accommodate fibrous material in the liquid and when the valve is opened and the can is filled with liquid to close off the vent tube, the liquid will be held in the spaces between the discs by the surface tension of the liquid to prevent overfilling of the can.

14 Claims, 2 Drawing Sheets

CAN FILLING MACHINE HAVING A MECHANISM TO PREVENT OVERFILL

BACKGROUND OF THE INVENTION

In a conventional filling machine for filling a can with a beverage, such as beer, soft drinks or fruit juice, the cans are fed by a star wheel conveyor to a filling machine and individually positioned on the surface of a rotating turntable beneath a filling head. With the can positioned on the surface, a cylindrical tulip mounted on the head is moved downwardly and sealed against the upper edge of the can. A conventional filling machine also includes a bowl or reservoir which is spaced above the supporting surface and contains the liquid or beverage. A vent tube and fill tube are mounted concentrically within the tulip and the upper ends of both tubes communicate with the bowl.

In a typical filling operation, as disclosed in the U.S. Pat. No. 4,938,261, after the tulip is sealed against the upper edge of the can, pure carbon dioxide from a separate reservoir is purged into the can and air from the can is simultaneously vented to the atmosphere. After the purging, a differential in force applied to opposite ends of the vent tube acts to lower the vent tube into the can, and the fill tube is then lowered to open a valve so that liquid is discharged from the bowl into the can, while gas in the can is discharged through the vent tube to the headspace of the bowl. During the filling cycle, liquid will rise in the can until the liquid level covers the lower end of the vent tube and the liquid will then rise in the vent tube to approximately the level of liquid in the bowl. To release liquid from the vent tube, the vent tube is lifted relative to the tulip to compress the gas in the upper end of the vent tube and force the liquid out of the vent tube and into the can. The gas is then released from the head space in the can to complete the filling operation.

One of the problems that arises in the filling operation is preventing overfill of the can. During the period when the valve is open, the can is filled with liquid until the liquid level closes off the lower end of the vent tube. To prevent overfill under these conditions it has been proposed to employ a narrow gap in the flow path of the liquid flowing to the can. The gap should be large enough to provide an adequate fill time and yet must be correlated with the surface tension of the liquid to prevent flow when the can is filled and the vent tube is closed off. In addition, rotation of the turntable which carries the filling head will tend to decrease the surface tension of the liquid, so that this factor must also be considered in determining the size of the gap.

In U.S. Pat. No. 4,938,261 an annular siphon valve is carried by the fill tube and includes an upturned peripheral edge, which is adapted to engage a seat on the housing. When the valve is open, the space between the peripheral edge of the valve and the valve seat provides a gap, which is intended to prevent overfill. However, it has been found that making the gap narrow enough to create the necessary surface tension and prevent overfill will restrict flow during filling so that the fill time is reduced.

It has also been proposed to incorporate an annular mesh screen in the lower end of the annular flow chamber between the fill tube and the housing, and above the valve. While the use of the screen has been found to provide adequate fill time and will create the desired surface tension to prevent overfill, the screen will not accommodate liquids containing fibrous material or pulp, so that the screen will tend to clog.

SUMMARY OF THE INVENTION

The invention is directed to a can filling apparatus and more particularly to an improved mechanism for preventing overfill of the can. In accordance with the invention, a tubular housing is mounted within an outer tulip and the housing has an upper end which communicates with a reservoir of a beverage or other liquid. A fill tube is mounted concentrically within the housing and is slidable relative to the housing. The annular space between the fill tube and the housing defines a flow chamber for the liquid.

Located concentrically within the fill tube is a vent tube and the open lower end of the vent tube communicates with the can to be filled.

The lower end of the fill tube carries a valve which is adapted to engage a valve seat on the housing. When the valve is open, liquid can flow from the annular flow chamber to the can.

In accordance with the invention, a stack of superimposed discs are located in the lower end of the flow chamber above the valve. In the preferred form of the invention, the discs are disposed horizontally and are spaced apart by spacers. The discs are provided with openings that preferably extend circumferentially, so that the liquid from the flow chamber will pass through the openings and then radially through the spaces between adjacent discs, and then through the open valve to the can.

Spacing between adjacent discs is sized so that there is adequate flow of liquid during filling of the can to provide the desired fill time and yet the spacing will accommodate fibrous material and is sufficiently narrow so that the surface tension of the liquid will prevent flow through the spaces after the can is filled and the lower end of the vent tube is closed by the liquid.

The use of the multiple, parallel flow passages for the liquid between the superimposed discs achieves the desired fill speed and yet each individual passage is narrow enough to create surface tension and prevent overfill. Moreover, the multiple flow passages are capable of accommodating fibrous material so that the machine can be used to fill cans with fruit juice or other liquids containing fibrous or pulpy materials.

Other objects and advantages will appear during the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
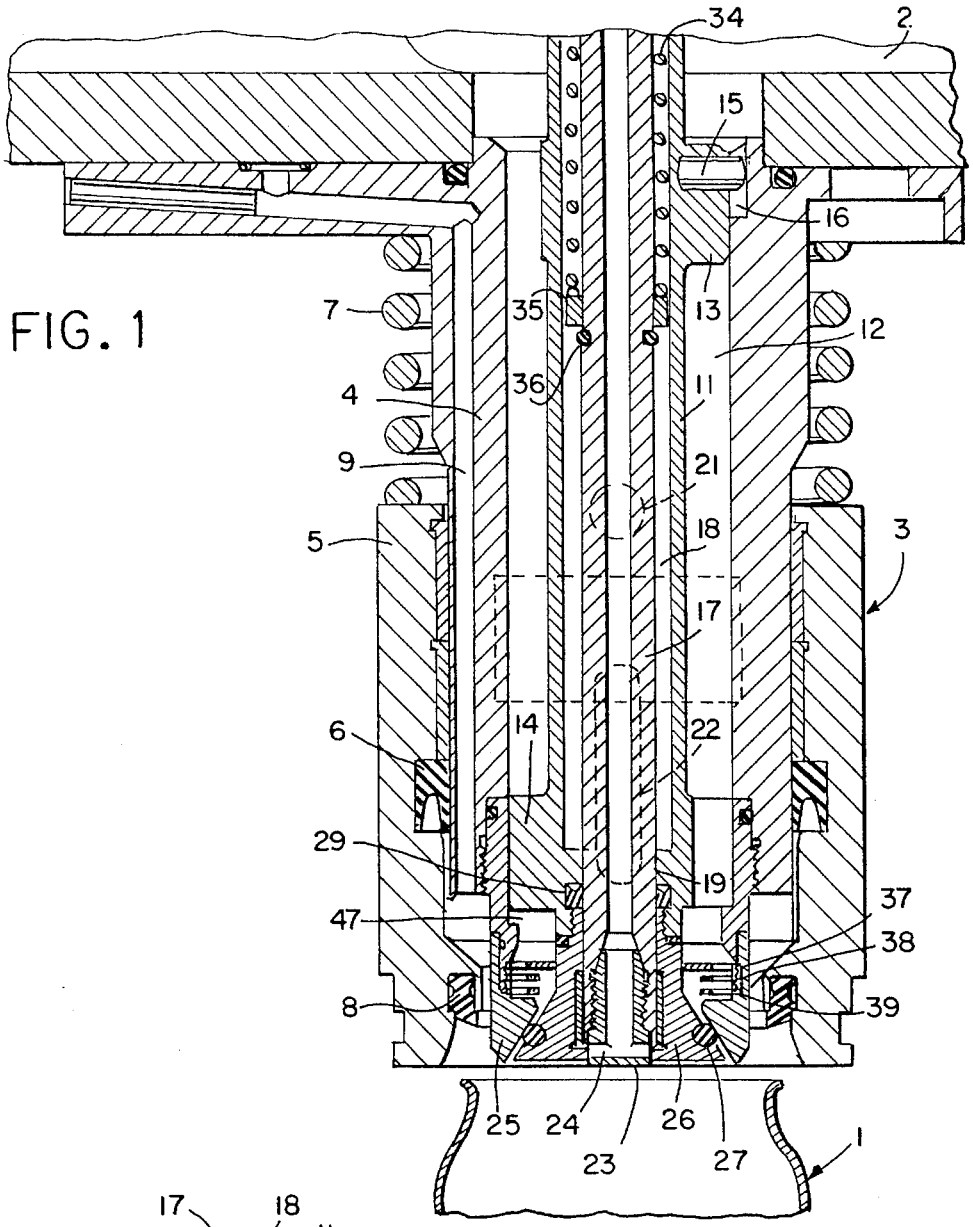
FIG. 1 is a fragmentary vertical section of the lower portion of a filling head with the vent tube being shown in the raised position.

The invention is directed to a can filling machine which is an improvement to that shown in U.S. Pat. No. 4,938,261 and more particularly to an improved mechanism for preventing overfill of the can. As disclosed in the aforementioned patent, the filling machine includes a rotatable turntable, having a support plate that supports a plurality of open top cans 1, which are adapted to be filled with a liquid or beverage such as beer, soft drinks, fruit juice of the like. A filling bowl 2 is mounted on the turntable above the support plate and a plurality of filling heads 3, only one of which is shown in the drawings, are supported from the bowl 2 and each is adapted to dispense a given quantity of liquid from the bowl into the respective can 1.

Each filling head 3 includes a tubular housing 4 which is attached to the undersurface of bowl 2 and communicates with the bowl. A cylindrical tulip 5 is mounted for sliding movement relative to housing 4 and a gasket 6 is mounted in a recess in the inner surface of the tulip and serves to seal the interface between the tulip 5 and housing 4.

Tulip 5 is biased downwardly into engagement with the upper edge of can 1 by coil spring 7 that is interposed between the upper end of housing 4 and the upper end of the tulip.

As disclosed in U.S. Pat. No. 4,938,261 the tulip 5 is raised to an elevated or release position by a cam mechanism. As a turntable rotates, the cam mechanism will elevate the tulip against the force of spring 7 to permit the can 1 to be introduced beneath the filling head 3. After the can is positioned beneath the filling head, further rotation of the turntable, as described in Pat. No. 4,938,261, will lower the tulip and permit the annular seal 8 on the lower end of the tulip to engage the upper end of the can 1 under the influence of spring 7.

Once the tulip 5 is sealed against the can 1, the can is purged with carbon dioxide as described in Pat. No. 4,938,261. The carbon dioxide is introduced into the can through the passage 9 in the housing 4. As the can is purged with carbon dioxide, the air from the can is vented to the atmosphere as described in the aforementioned patent.

Located concentrically within housing 4 is a fill tube 11. The upper end of the fill tube communicates with bowl 2, as described in U.S. Pat. No. 4,938,261. The space between the fill tube 11 and housing 4 constitutes an annular flow channel 12.

To space fill tube 11 concentrically within housing 4, the upper end of the fill tube is provided with a plurality of circumferentially spaced projections 13, which extend radially from the fill tube and engage the inner wall of housing 4. Similarly, the lower end of the fill tube is provided with a plurality of circumferentially spaced lower projections 14 which extend radially and engage the inner wall of the housing. In practice, the fill tube may contain three upper projections 13 as well as three lower projections 14.

Fill tube 11 is slidable relative to housing 4, and to prevent rotation of the fill tube relative to the housing, a pin 15 is mounted within a radial hole in one of the projections 13 and the outer end of the pin is slidable within an elongated vertical slot 16 formed in the inner wall of housing 4.

Figure 2:
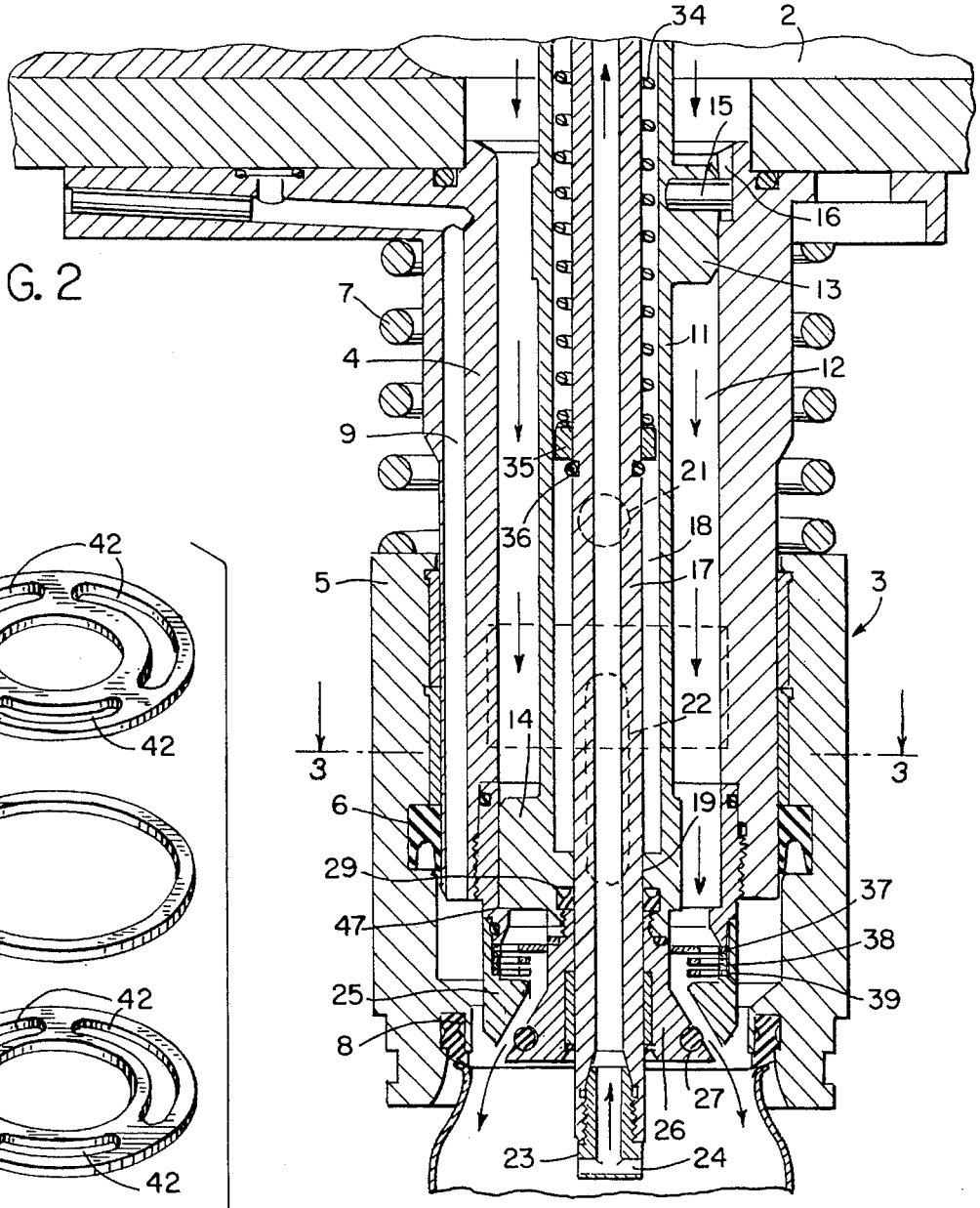
FIG. 2 is a view similar to FIG. 1 showing the vent tube in the lowered position.

Located concentrically within fill tube 11 is a vent tube 17, which can be constructed in the manner shown in U.S. Pat. No. 4,938,261. The space between vent tube 17 and fill tube 11 constitutes an annular chamber 18. As shown in FIGS. 1 and 2, the lower end of fill tube 11 is provided with an axial opening 19 which slidably receives vent tube 17.

To provide communication between the chamber 18 and the flow channel 12, fill tube 11 is provided with a pair of holes 21 as well as a pair of elongated openings 22. During cleaning, any liquid within the chamber 18 can drain through the openings 21 and 22 into the flow channel 12.

The lower end of vent tube 17 carries a tip 23 and the tip is provided with a radial passage 24 which communicates with the axial opening in the vent tube.

Figure 4:
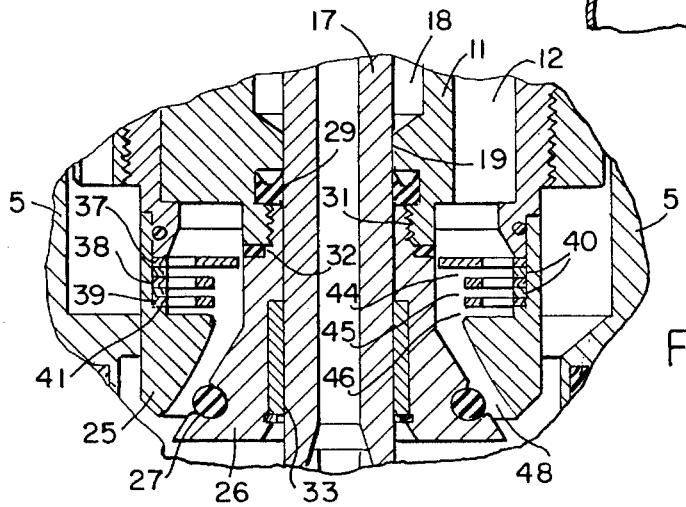
FIG. 4 is an enlarged fragmentary vertical section showing the stack of discs in the flow channel.

An annular valve seat member 25 is mounted on the lower end of housing 4, while a annular valve member 26 is connected to the lower end of fill tube 11. As best shown in FIG. 4, valve member 26 is formed with an annular groove that receives O-ring 27 and the O-ring is adapted to engage and the valve seat 25 to close off the flow from the flow channel 12 to the can 1.

The lower end portion of fill tube 11 is formed with an annular recess 28, which receives a seal 29. Seal 29 serves to seal the interface between the fill tube 11 and vent tube 17.

The lower end of fill tube 11 is connected to the upper end of valve 26 through a threaded connection indicated by 31, and an annular seal 32 is positioned at the interface between the lower end of fill tube 11 and the upper surface of valve 26, as best seen in FIG. 4.

Mounted within a recess in the inner surface of valve 26 is a bushing 33 which facilitates sliding movement of vent tube 17 relative to valve 26 and fill tube 11.

Valve 26 is biased to a closed position by a coil spring 34 which is located in the chamber 18 between fill tube 11 and vent tube 17. The lower end of spring 34 is engaged with a seat 35 that is held in position by engagement with a retaining clip 36 mounted within a groove in the outer surface of vent tube 17. The force of spring 34, as described in U.S. Pat. No. 4,938,261, will urge the fill tube 11 upwardly relative to the vent tube 17 to hold the valve 26 in a closed position.

In accordance with the invention, a mechanism is located in the lower portion of flow channel 12 that is adapted to prevent overfill of the can. The mechanism includes a plurality of superimposed spaced discs including an upper disc 37, an intermediate disc 38 and a lower disc 39. Discs 37–39 are spaced apart by spacing rings 40.

The outer peripheries of discs 37–39 as well as the spacers 40, are mounted between the lower end of housing 4, and a shoulder 41 on valve seat 25. Upper disc 37 extends completely across the flow channel 12 while the discs 38 and 39, as best shown in FIG. 4, have a lesser radial dimension and extend only partially across the channel 12.

Figure 5:
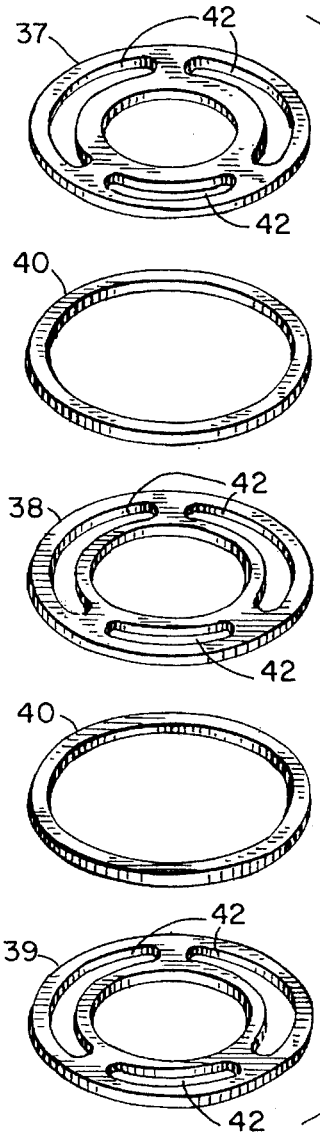
FIG. 5 is an exploded view of the discs.
Figure 3:
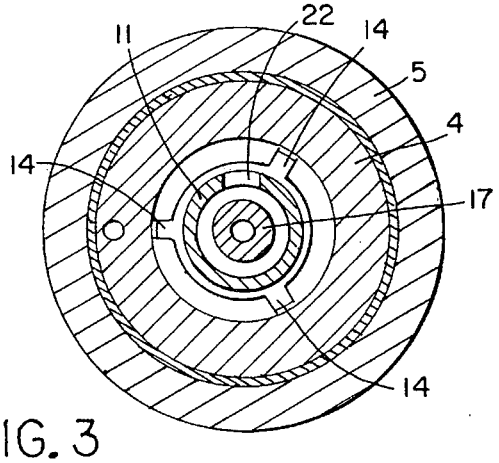
FIG. 3 is a section taken along line 3—3 of FIG. 2.

As illustrated in the exploded view FIG. 5, discs 37–39 are provided with curved or arcuate openings 42, and the openings in the discs are preferably aligned.

In the preferred form of the invention, the discs are horizontal and the clearance between adjacent discs defined by the spacers 40 constitute flow passages 44, 45 and 46 for the liquid. During filling of the can with the valve 26 in the open position, the liquid will flow through the openings 42 in the discs and then radially inward through the spaces or passages 44–46 and then through the open valve to the can.

The operation of the filling machine is similar to that described in U.S. Pat. No. 4,938,261. After the can has been purged with carbon dioxide and the air in the can vented, rotation of the turntable will act to lower the fill tube 11 and open the valve 26. This action also serves to lower the vent tube 17 to provide communication between the central passage in the vent tube and the headspace of the filling bowl 2. Downward movement of the fill tube 11 and valve 26 is limited by the engagement of the projections 14 with the shoulder 47 of the housing.

With the valve 26 open, liquid will then flow through the annular flow channel 12, through the openings 42 in discs 37–39, then radially through the spaces between the discs and through the open valve 27 into the can. Gas from the can will be vented to the vent tube 17 to the headspace of the fill bowl 2.

When the liquid in the can 1 rises to a level to close off the lower end of vent tube 17, the liquid will rise in the vent tube to a level approximating that in the level of the bowl 2. Liquid in the conical passage 48 between valve seat 25 and valve 26 will flow downwardly into the can and the pressure of the gas in the headspace of the can will increase slightly. The increased pressure along with the surface tension of the liquid will prevent additional liquid from flowing through the spaces 44–46 into the can.

The multiple parallel flow passages 44–46 enable the machine to have the desired fill speed and yet each flow path is sufficiently narrow so the liquid will bridge the passage by surface tension to prevent overfill. The flow passages 44–46 can be adjusted in width to accommodate fibrous material, so that the machine can be employed for filling cans with pulpy or fibrous material, such as fruit juice, or the like.

Various modes of carrying out the invention are contemplated as being within the scope of the following claims particularly pointing out and distinctly claiming the subject matter which is regarded as the invention.

I claim:

1. In a can filling apparatus, a tubular housing having an upper end communicating with a supply of liquid, a fill tube mounted for sliding movement relative to said housing and spaced inwardly from the housing to provide an annular flow channel therebetween, a vent tube mounted within the fill tube and having an open lower end disposed to communicate with a can to be filled, valve means interconnecting the lower end of the housing and the fill tube for opening and closing said flow channel, flow restricting means disposed in said flow channel and comprising a stack of discs, and spacing means for spacing the discs apart to provide flow passages between adjacent discs, an uppermost disc of said stack extending radially completely across the flow channel and a next lower disc extending only partially across said channel, each disc having an aperture so that liquid flowing in said flow channel will flow through the aperture in the uppermost disc to the passage between the uppermost disc and the next lower disc and then will flow radially through said passage and through said open valve means to the can.

2. The apparatus of claim 1, wherein the discs are annular in configuration.

3. The apparatus of claim 2, wherein said discs are disposed horizontally.

4. The apparatus of claim 1, wherein said valve means comprises a valve seat member connected to the housing, and a valve member connected to said fill tube and disposed to engage said valve seat member.

5. The apparatus of claim 4, wherein said valve member is annular in configuration, said apparatus also including an annular seal mounted on said valve member and disposed to engage said valve seat member.

6. The apparatus of claim 1, wherein the apertures in each disc extend circumferentially of the disc.

7. The apparatus of claim 1, wherein said spacing means comprises a spacing ring located between adjacent discs, said spacing ring having an axial dimension sufficient to permit flow of fibrous material in said flow passages and to hold the liquid in said passages by surface tension when the liquid level in the can closes off the vent tube.

8. The apparatus of claim 5, wherein said flow restricting means comprises an upper disc, an intermediate disc and a lower disc, the space between the upper disc and the intermediate disc comprising a first flow passage and the space between the intermediate disc and said lower disc comprising a second flow passage and a space between the lower disc and said housing constituting a third flow passage.

9. The apparatus of claim 8, wherein the combined cross-sectional area of said flow passages is less than the cross-sectional area between said valve seat member and said valve member when said valve member is in the open position.

10. In a can filling apparatus, a tubular housing having an upper end communicating with a supply of liquid, a fill tube mounted for sliding movement relative to said housing and spaced inwardly from the housing to provide an annular flow channel therebetween, a vent tube mounted within the fill tube and having an open lower end disposed to communicate with a can to be filled, valve means interconnecting the lower end of the housing and the fill tube for opening and closing said flow channel, flow restricting means disposed in the lower portion of said flow channel above said valve means, said flow restricting means comprising a stack of vertically spaced horizontal discs mounted on said housing, and spacing means for spacing the discs apart to provide a radially extending flow passage between adjacent discs, the uppermost disc extending completely across said annular flow channel and the next lowermost disc extending only partially across said annular flow channel, said discs each having an aperture, liquid flowing downwardly from said annular flow channel passing through the aperture in the uppermost disc to the flow passage between the uppermost disc and the next lower disc and then flowing radially through said passage and through the open valve means to the can.

11. The apparatus of claim 10, wherein the apertures extend generally circumferentially of the discs.

12. The apparatus of claim 11, wherein the apertures are in vertical alignment.

13. The apparatus of claim 10, wherein said spacing means comprises a spacing ring located between adjacent discs, said spacing ring having an axial dimension sufficient to permit flow of fibrous material in said flow passages and to hold the liquid in said passages by surface tension when the liquid level in the can closes off the vent tube.

14. In a can filling apparatus, a tubular housing having an upper end communicating with a supply of liquid, a fill tube mounted for sliding movement relative to said housing and spaced inwardly from the housing to provide an annular flow channel therebetween, a vent tube mounted within the fill tube and having an open lower end disposed to communicate with a can to be filled, valve means interconnecting the lower end of the housing and the fill tube for opening and closing said flow channel, a stack of vertically spaced generally horizontal discs mounted on said housing and disposed in said flow channel, spacing means for spacing the discs vertically apart to provide radially extending first flow passages between adjacent discs, and an annular inwardly extending shoulder on said housing and disposed in parallel spaced relation beneath a lowermost disc of said stack to provide a second flow passage between the lowermost disc and said shoulder, said discs each having an aperture therein, liquid flowing downwardly in said annular flow channel passing through the apertures in the discs to the first and second flow passages and then flowing radially through said flow passages and through the open valve means to said can.

* * * * *